United States Patent [19]

von Entress-Fürsteneck

[11] Patent Number: 4,807,533

[45] Date of Patent: Feb. 28, 1989

[54] ARTILLERY PROJECTILE CONTAINING SUBMUNITIONS

[75] Inventor: Wolfgang von Entress-Fürsteneck, Leinburg, Fed. Rep. of Germany

[73] Assignee: Diehl GmbH & Co., Nuremberg, Fed. Rep. of Germany

[21] Appl. No.: 101,651

[22] Filed: Sep. 28, 1987

[30] Foreign Application Priority Data

Oct. 17, 1986 [DE] Fed. Rep. of Germany ..... 3635361

[51] Int. Cl.[4] ..... F42B 13/50

[52] U.S. Cl. ..... 102/489; 102/476; 102/501

[58] Field of Search ..... 102/489, 501, 476, 340, 102/342, 351, 357, 393, 498, 529

[56] References Cited

U.S. PATENT DOCUMENTS 1,090,007 3/1914 Ziegenfuss ..... 102/338
3,946,672 3/1976 Adams et al. ..... 102/393
4,013,009 3/1977 Claude et al. .

FOREIGN PATENT DOCUMENTS 2205074 3/1977 Fed. Rep. of Germany ..... 102/476
3326876 4/1986 Fed. Rep. of Germany .
1536065 12/1978 United Kingdom .

*Primary Examiner*—Charles T. Jordan
*Assistant Examiner*—Richard Klein
*Attorney, Agent, or Firm*—Scully, Scott, Murphy & Presser

[57] ABSTRACT

An artillery projectile or shell containing a plurality of submunitions of the same type, each of which possesses a projectile-forming charge, an antenna on one side thereof, and a flight-stabilizing device on the opposite side. The submunitions are configured and arranged such that the projectile possesses the same location for the center of gravity and the same weight as would an artillery projectile or shell which has been introduced in the practice and which is filled with a charge.

4 Claims, 1 Drawing Sheet

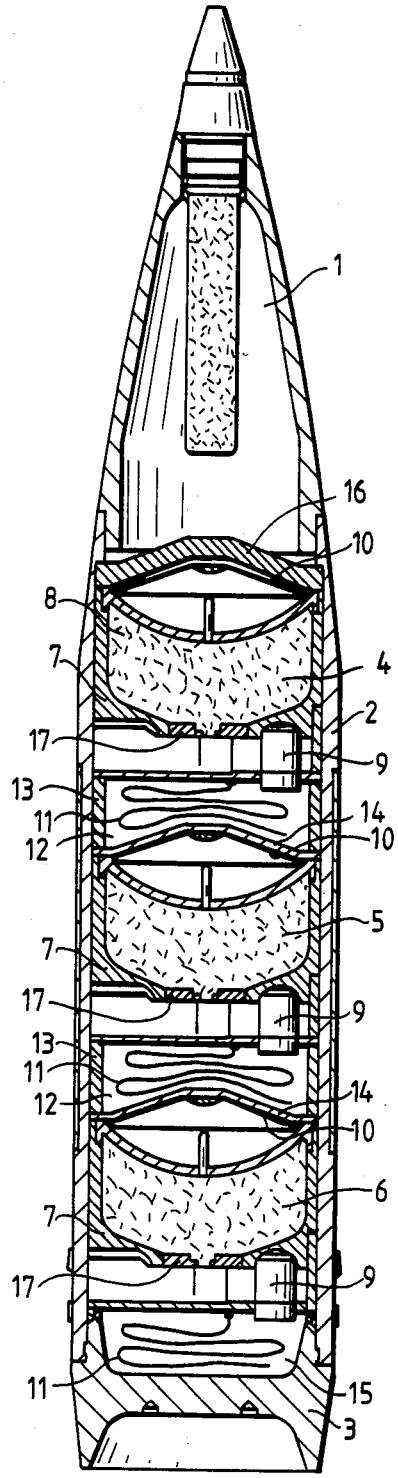
1
16
10
8
7
4
2
17
9
13
11
14
12
10
5
7
17
9
13
11
14
12
10
6
7
17
9
11
15
3

ARTILLERY PROJECTILE CONTAINING SUBMUNITIONS

BACKGROUND OF THE INVENTION

1. Field of the Invention

The present invention relates to an artillery projectile or shell containing a plurality of submunitions of the same type, each of which possesses a projectile-forming charge, an antenna on one side thereof, and a flight-stabilizing device on the opposite side.

2. Discussion of the Prior Art

It is known that articles of submunition can be arranged within artillery projectiles. These submunitions are expelled from the artillery projectile over the target area, whereupon the flight stabilizing devices, for example, such as parachutes, become operative.

As a rule, when an artillery projectile is equipped with submunitions, an artillery projectile of that kind has a weight and center of gravity which differ from that of a corresponding artillery projectile which is filled with an explosive charge. This particular aspect must be considered during firing.

SUMMARY OF THE INVENTION

Accordingly, it is an object of the present invention to provide an artillery projectile of the abovementioned type in which the submunitions are configured and arranged in such a manner, that the projectile possesses the same location for the center of gravity and the same weight as would an artillery projectile or shell which has been introduced in the practice and which is filled with a charge.

Inventively, the foregoing object is attained in that at least two submunitions are arranged axially superimposed within the casing of the projectile, in which a hollow air space is formed between two adjacent submunitions, which is subdivided through the intermediary of a cone-shaped separating cover or plate, wherein the air space at the convex side of the separating cover has the flight stabilizing device for the one submunition stored therein, and the air space on the concave side of the separating cover has the antenna of the adjacent submunition located therein.

Through the dimensioning of the storage space intermediate the at least two articles of submunition, the latter can be distributed in such a manner within the projectile casing, whereby the center of gravity and the weight of the artillery projectile will coincide with that of an artillery projectile which is filled with a charge. Hereby, there will also cover or coincide themselves the moments of inertia of the artillery projectile about the longitudinal axis and the transverse axis.

BRIEF DESCRIPTION OF THE DRAWINGS

Preferred embodiments and further advantages and features of the invention may now be readily ascertained from the following detailed description of an exemplary embodiment of an artillery projectile, taken in conjunction with the accompanying single figure of drawing showing a longitudinal sectional view through the inventive artillery projectile.

DETAILED DESCRIPTION

A projectile includes a nose cone or head portion 1, a projectile casing 2 and a projectile base 3. Arranged in an axial alignment within the projectile casing 3 are three submunitions 4, 5, 6. Each of the submunitions 4, 5, 6 incorporates a projectile-forming charge 8 within a housing 7, as well as a fuze device 9. A antenna 10 is located on one side of each of the respective submunitions 4, 5 and 6. A parachute 11 is fastened to the opposite side of each submunition.

Intermediate, respectively, the middle submunition 5 and the submunition 4, and the submunition 5 and the submunition 6, there is provided a hollow air space 12. The height of each air space is determined by a spacer or insert sleeve 13. The insert sleeve 13 maintains the adjacent submunitions in a spaced apart condition.

The air space 12 is subdivided through a cone-shaped or dish-like separating cover 14. Located in the air space 12 on the convex side of the separating cover 14, is the parachute 11 of the respective submunition 4 or 5. In the air space 12 on the concave side of the separating cover 14, there is located the antenna 10 of the respective submunition 5 or 6.

For the stowage of the parachute 11 for the submunition 6, a recess 15 is provided in the projectile base 3. The antenna 10 of the uppermost submunition 4 extends below a closure plate 16, which is constructed cone-shaped in conformance with the configuration of the antenna 10.

In order to achieve a sufficient damming for the projectile formation of the charge 8, a damming plate 17, which for example, may be constituted of steel, is inserted into the base of each housing 7.

By means of the above-described arrangement, the inventive projectile is imparted a weight and a center of gravity which is identical with that of an ordinary artillery projectile or shell possessing the same dimensions.

What is claimed is:

1. An artillery projectile having a casing containing a plurality of submunitions of the same type, each said submunition including a projectile-forming charge, an antenna arranged on one side thereof and a flight-stabilizing means on the opposite side; at least two of said submunitions being axially superimposed within the casing of said projectile; an insert sleeve in said casing to provide a hollow air space between two adjacent submunitions; a separating cover which is conical in cross-section extending transversely across the interior of said projectile casing intermediate said two adjacent submunitions for subdividing said air space; the flight-stabilizing means for one said submunition being located in the air space on the convex side of the separating cover, and the antenna of the adjacent submunition being located in the air space on the concave side of the separating cover.

2. An artillery projectile as claimed in claim 1, wherein said insert sleeve and said separating cover are constituted of separate components.

3. An artillery projectile as claimed in claim 1, wherein a closure plate provides a covering for the antenna of the uppermost submunition in said projectile.

4. An artillery projectile as claimed in claim 1, wherein said projectile includes a base having an internal recess for the stowage of the flight-stabilizing means of the lowermost submunition in the projectile.

* * * * *